United States Patent [19]

Nowak et al.

[11] Patent Number: 4,644,768

[45] Date of Patent: Feb. 24, 1987

[54] DISC TUMBLER CYLINDER LOCK

[75] Inventors: Claude Nowak, Wettingen; Peter Landis, Neuenhof, both of Switzerland

[73] Assignee: Uniswitch AG., Wettingen, Switzerland

[21] Appl. No.: 630,390

[22] Filed: Jul. 13, 1984

[30] Foreign Application Priority Data

Jul. 26, 1983 [CH] Switzerland ..... 4079/83

[51] Int. Cl.[4] ..... E05B 15/14; E05B 29/04

[52] U.S. Cl. ..... 70/364 R; 70/377

[58] Field of Search ..... 70/364 R, 377, 392, 70/376, 350, 352, DIG. 29

[56] References Cited

U.S. PATENT DOCUMENTS

| | | | |
|---|---|---|---|
| Re. 20,143 | 10/1936 | Gray | 70/364 R |
| 1,470,810 | 10/1923 | Charlton | 70/377 X |
| 1,725,557 | 8/1929 | Baird | 70/377 X |
| 1,850,323 | 3/1932 | Heyer | 70/377 X |
| 1,860,708 | 5/1932 | Falk | 70/377 X |
| 1,877,404 | 9/1932 | Jacobi | 70/364 R X |
| 1,990,794 | 2/1935 | McCormac | 70/364 R |
| 2,047,966 | 7/1936 | Jacobi | 70/364 R |
| 2,058,893 | 10/1936 | Ledin | 70/377 X |
| 2,483,365 | 9/1949 | Feldman | 70/364 R X |
| 2,790,318 | 4/1957 | Jannette | 70/375 X |
| 3,699,790 | 10/1972 | Ansala | 70/364 R |
| 3,735,614 | 5/1973 | Keller-Volper | 70/377 |

FOREIGN PATENT DOCUMENTS

| | | | |
|---|---|---|---|
| 132579 | 2/1985 | European Pat. Off. | 70/364 R |
| 2041061 | 9/1980 | United Kingdom | 70/364 R |

*Primary Examiner*—Robert L. Wolfe
*Assistant Examiner*—Russell W. Illich
*Attorney, Agent, or Firm*—Peter K. Kontler

[57] ABSTRACT

A disc tumbler cylinder lock wherein the cylinder has transverse slots for frame-like tumblers having enlarged portions normally extending into the case for the cylinder under the action of springs to thus prevent rotation of the cylinder except on insertion of a proper key which retracts the tumblers into the cylinder. The enlarged portions are wedges which form part of U-shaped or Z-shaped sections of the frames.

9 Claims, 6 Drawing Figures

Fig. 3
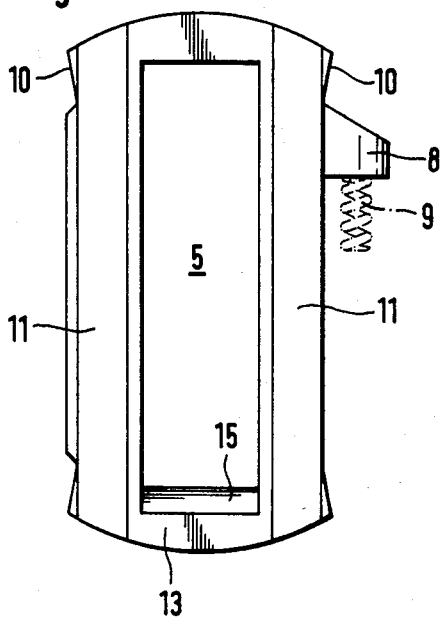
Fig. 5
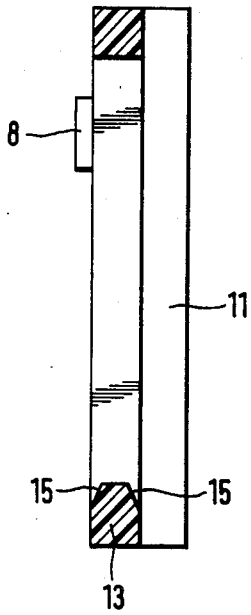
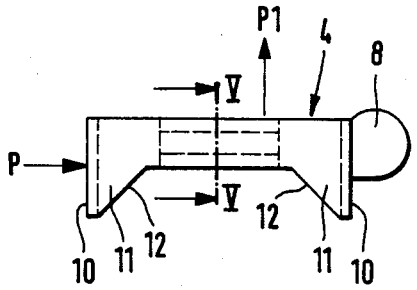
Fig. 4
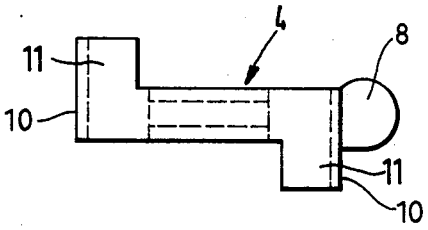
Fig. 6

DISC TUMBLER CYLINDER LOCK

BACKGROUND OF THE INVENTION

The present invention relates to cylinder type safety locks in general, and more particularly to improvements in disc tumbler cylinder locks. Still more particularly, the invention relates to improvements in disc tumbler cylinder locks of the type wherein frame-like tumblers are reciprocable in a cylinder which can be rotated in a case on retraction of all tumblers into its interior in response to insertion of a proper key into the hole of the cylinder and into registering passages of the tumblers. In such types of locks, the frame-like tumblers include portions which normally extend from the cylinder under the action of suitable springs to bear against complementary portions of the case and to thus prevent rotation of the cylinder and attendant opening of the safety lock.

A drawback of presently known safety locks of the above outlined character is that the frame-like tumblers are relatively thin and are in relatively small surface-to-surface contact with the cylinder and/or the case. Thus, if an improper key is inserted into the hole of the cylinder and the passages of the relatively thin tumblers, and the manipulator attempts to turn the key with the cylinder, the pressure per unit area of surfaces of contact between the tumblers and the case for the cylinder is very pronounced, especially if the number of tumblers is rather small and if only a small portion of each tumbler which is not fully confined in the cylinder extends into and engages the case. This can entail damage to or even total destruction of the lock.

OBJECTS AND SUMMARY OF THE INVENTION

An object of the invention is to provide a novel and improved safety lock which is constructed and assembled in such a way that its tumblers can stand longer periods of use and more pronounced stresses than the tumblers of heretofore known safety locks.

Another object of the invention is to provide novel and improved frame-like disc tumblers for use in a safety cylinder lock.

A further object of the invention is to provide a safety cylinder lock wherein a small number of tumblers suffices to withstand the force of an improper key which is manipulated for the purpose of turning the cylinder in its case.

An additional object of the invention is to provide the tumblers of a safety cylinder lock with novel and improved case-engaging portions.

Another object of the invention is to provide a compact, rugged and simple safety cylinder lock which can operate satisfactorily with a relatively small number of simple and inexpensive tumblers.

Still another object of the invention is to provide the tumblers of a safety cylinder lock with novel and improved key-contacting portions and with novel and improved cylinder-containing portions.

The invention is embodied in a disc tumbler cylinder lock which comprises a case, a cylinder which is rotatably mounted in the case and has a substantially axially extending key hole, a plurality of disc tumblers which are disposed transversely of the axis of the cylinder, which are reciprocable in slots provided therefor in the cylinder and which have passages for the corresponding portions of a key which is inserted into the key hole, and means for biasing the tumblers transversely of the cylinder to thereby urge the tumblers into the case and prevent rotation of the cylinder in the case. In accordance with a feature of the invention, the tumblers include enlarged portions (each tumbler can comprise a total of four enlarged portions) at least some of which extend into the case under the action of the respective biasing means to prevent rotation of the cylinder in the case in the absence in the key hole of a proper key which maintains the enlarged portions of the tumblers in the interior of the cylinder against the opposition of the biasing means. Each of the tumblers can comprise or constitute a frame which is provided with the respective passage, and each such frame includes a section (preferably a wedge-like section) which is urged against the serrated portion of the inserted key by the respective biasing means. Each frame includes a major portion of predetermined width, as considered in the axial direction of the cylinder, and the width of the aforementioned enlarged portions exceeds such predetermined width so that each enlarged portion can be biased into large surface-to-surface contact with the case when the proper key is withdrawn from the key hole or when the key hole receives an improper key. Each enlarged portion can include a rib and can resemble a wedge. In accordance with one presently preferred embodiment, the tumblers include substantially Z-shaped sections each of which is integral with the respective frame and each of which has at least one but preferably two enlarged portions. Alternatively, each tumbler can be provided with at least one substantially U-shaped section which is integral with the respective frame and has one or more enlarged portions. If the enlarged portions are substantially wedge-like parts, they preferably taper in directions toward the respective frames. The wedge-like portions of the frames which are biased into engagement with the serrated portion of an inserted key preferably taper in directions toward the respective passages.

The novel features which are considered as characteristic of the invention are set forth in particular in the appended claims. The improved lock itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is an enlarged front elevational view of a disc tumbler;

FIG. 4 is a plan view of the tumbler which is shown in FIG. 3;

FIG. 5 is a sectional view as seen in the direction of arrows from the line V—V of FIG. 4; and FIG. 6 is a plan view of a modified tumbler.

DESCRIPTION OF THE PREFERRED EMBODIMENTS

Figure 1:
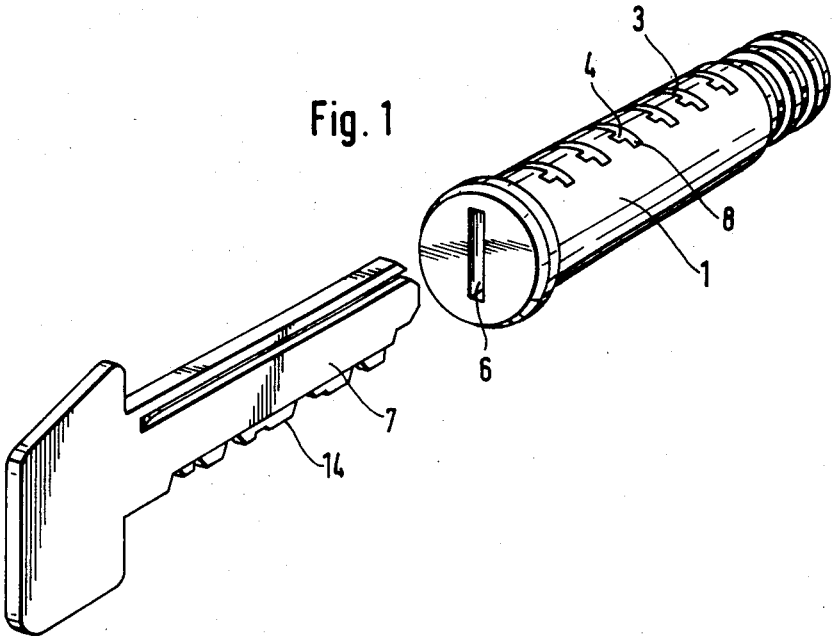
FIG. 1 is a perspective view of a cylinder with six frame-like, disc tumblers and of a key which can be used to rotate the cylinder in its case.
Figure 2:
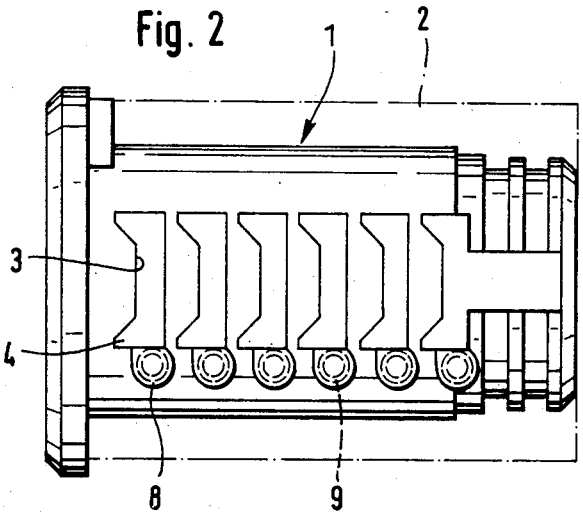
FIG. 2 is an enlarged plan view of the cylinder, with the case indicated by phantom lines.

The safety cylinder lock which is shown in FIGS. 1 to 5 comprises a cylinder or barrel 1 having an axially extending key hole 6 and six transversely extending slots 3 for specially designed disc-shaped tumblers 4. The cylinder 1 is rotatably mounted in a housing or case 2 (indicated in FIG. 2 by phantom lines) and can be rotated relative to the case by a proper key 7 when the latter is inserted into the hole 6 and maintains all of the tumblers 4 in the cylinder 1 or retracts the tumblers to an extent which is needed to allow for rotation of the cylinder in its case. The slots 3 extend transversely of the axis of the cylinder 1 and are preferably (but need not be) equidistant from one another, as considered in the axial direction of the cylinder. The number of slots 3 and tumblers 4 can be reduced to less than six or increased to seven or more.

Each of the tumblers 4 comprises a frame (see particularly FIG. 3) which has a centrally located passage 5 for the key 7 and includes a wedge-like section 13 bounded by mutually inclined facets 15 (see FIG. 5) and arranged to bear against the serrated portion 14 of the key 7 when the latter is inserted into the hole 6 of the cylinder 1. A lateral projection 8 of the frame of each tumbler 4 is biased by a discrete coil spring 9 which is installed in and reacts against the cylinder 1 to urge the respective tumbler 4 upwardly, as viewed in FIG. 3 or 5, so as to maintain the wedge-like section 13 of the frame in engagement with the serrated portion of the key or to bias a portion of each tumbler 4 beyond the respective slot 3 and into a complementary recess (not specifically shown) of the case 2 so that the latter prevents rotation of the cylinder 1 until and unless the hole 6 has received the proper key and such key has been properly inserted through all of the passages 5. The cross-sectional outlines of the tumblers 4 are generally complementary to the outlines of surfaces bounding the respective slots 3 in the cylinder 1.

As can be seen in FIG. 3, the two longitudinal ends of each tumbler 4 are provided with pairs of enlarged portions 10. One pair of such enlarged portions 10 extends into the aforementioned recess (e.g., a groove) in the case 2 when the respective spring 9 is free to expand whereby the enlarged portions 10 abut against the adjacent portions of the case 2. Since the portions 10 are enlarged, they are in rather large surface-to-surface contact with the case 2 and cannot be deformed or destroyed when an authorized or unauthorized person attempts to open the lock with an improper key which may fit into the hole 6 but cannot move the tumblers 4 to requisite positions in order to allow for rotation of the cylinder 1. Each of the enlarged portions 10 resembles a wedge which tapers in a direction toward the main portion of the respective frame. FIG. 4 shows clearly that the width of each enlarged portion 10, as considered at right angles to the general plane of the respective tumbler 4, considerably exceeds the width of the major portion of the corresponding frame. Reinforcing or enlargement of all four corner portions of the frame of each tumbler 4 contributes significantly to the resistance which the tumblers offer to rotation of the cylinder 1 through the medium of an improper key or an improperly inserted key, and such reinforcing thus contributes to longer useful life of the tumblers and of the entire safety lock. Each enlarged portion 10 can be said to constitute a portion of a substantially wedge-shaped elongated rib 11 which is integral with and extends longitudinally of the respective frame. As can be seen in FIG. 4, a pair of neighboring enlarged portions 10 and the frame portion therebetween can constitute a substantially U-shaped body. Alternatively, and as shown in FIG. 6, the projections 10 can extend to opposite sides of the general plane of the respective tumbler to constitute with the adjacent portion of the frame a substantially Z-shaped body. The reference characters 12 denote the sloping flanks of the ribs 11.

It is preferred to employ relatively large enlarged portions 10 in order to increase the area of contact with the surfaces bounding the groove in the case 2 and to thus reduce the pressure per unit area of such surfaces when the user of a key attempts to forcibly rotate the cylinder 1 while the tumblers (or at least one or a few tumblers) are not in proper positions to permit rotation of the cylinder.

The arrow P denotes in FIG. 4 the direction in which a resultant force acts upon the respective enlarged portion 10 when an attempt is made to turn the cylinder 1 in the case 2 while at least one of the tumblers 4 is not in proper position. The resultant force P acts upon the tumbler 4 in response to the application of torque by way of an improperly inserted or improper key. Such force P causes the development of a component or vector P1 which urges the tumbler 4 against the adjacent internal surface of the cylinder 1 and causes the tumbler to jam in the respective slot 3 to even further reduce the likelihood of unauthorized opening of the lock.

The provision of enlarged portions 10 and reinforcing ribs 11 does not contribute significantly to the weight and/or bulk and/or size of the tumblers 4 since such enlarged portions are provided only at the four corners of the respective frames and the ribs 11 extend along the two longer sides of the respective frames. The configurations of the adjacent portions of the slots 3 are complementary so as to allow for retraction of enlarged portions 10 into the cylinder 1 in response to proper insertion of a satisfactory key. The utilization of relatively thin tumblers is desirable and advantageous because such thin tumblers do not contribute to the bulk of the lock (especially to the length of the cylinder 1). Also, a substantial number of relatively thin reinforced tumblers can be installed in a relatively short cylinder.

As mentioned above, the springs 9 urge the wedge-like sections 13 of the respective frames into engagement with the serrated portion 14 of an inserted key 7.

If it is desired to further enlarge the portions 10, i.e., to further increase the area of surface-to-surface contact between each tumbler and the case 2, this can be achieved without increasing the number of serrations on the key (i.e., without resorting to a longer cylinder 1) by enlarging the portions 10 in such a way that the spacing between neighboring tumblers 4 (and hence between neighboring slots 3 of the cylinder 1) need not be increased. This can be achieved by the simple expedient of providing the frame of each tumbler 4 with a wedge-like portion 13 which tapers in a direction toward the respective passage 5 so that it can enter a relatively narrow tooth space between two neighboring teeth on the serrated portion 14 of the key 7. Such undertaking renders it possible to make satisfactory tumblers 4 of a non-metallic (particularly a suitable synthetic plastic) material whose hardness need not be highly pronounced since the enlarged portions 10 are in large surface-to-surface contact with the case 2 and prevent unauthorized turning of the cylinder 1 by means of a wrong key or an improperly inserted key. In fact, the cylinder 1, the case 2 and the key 7 can also be made of a suitable synthetic plastic material. This is desirable and advantageous when the lock is to constitute a switch lock and must be made, at least in part, of an electrically insulating material.

It is also within the purview of the invention to make the enlarged portions 10 in the form of blocks, i.e., it is not always necessary to resort to wedge-like enlarged portions. For example, each of the two enlarged portions which are shown in FIG. 6 can constitute a cube or an analogous body. Such configuration of the enlarged portions also brings about the aforediscussed advantages, especially as concerns a pronounced increase of the surface-to-surface contact with the case 2.

The illustrated tumblers 4 or analogous tumblers can be produced by stamping, punching or with resort to other known techniques which render it possible to mass-produce such parts with the requisite degree of accuracy. The provision of enlarged portions entails an increase in the area of contact between the tumblers and the surfaces bounding the respective slots 3 with the result that the tumblers are more accurately guided in the cylinder 1.

Wedge-like enlarged portions are preferred at the present time because they tend to become wedged in and jam in the case 2 and/or cylinder 1 in response to attempted rotation of the cylinder by a wrong key or by an improperly inserted key.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a disc tumbler cylinder lock, the combination of a case; a cylinder rotatably mounted in said case and having a key hole; a plurality of disc tumblers disposed transversely of the axis of said cylinder, said cylinder having slots reciprocably receiving said tumblers and surfaces surrounding said slots, each of said tumblers having spaced-apart ribs extending transversely of the axis of said cylinder and a passage for the corresponding portion of a key, the cross-sectional outlines of said tumblers being substantially complementary to the outlines of surfaces surrounding the respective slots so that the ribs as well as the tumbler portion between the ribs are in large surface-to-surface contact with said cylinder in each position of the tumblers; and means for biasing said tumblers transversely of said cylinder to thereby urge said tumblers into said case, said tumblers including portions extending into said case under the action of said biasing means to prevent rotation of said cylinder in said case in the absence in said key hole of a proper key which maintains said enlarged portions in the interior of said cylinder against the opposition of said biasing means.

2. The combination of claim 1, wherein each of said tumblers includes a frame which is provided with the respective passage, each of said frames including a section which is urged against the key in said hole by the respective biasing means.

3. The combination of claim 2, wherein each of said frames has a major portion of a predetermined width, as considered in the axial direction of said cylinder, and the width of said portions of said tumblers exceeds said predetermined width.

4. The combination of claim 1, wherein each of said tumblers includes two substantially wedge-shaped ribs.

5. The combination of claim 3, wherein said tumblers further include substantially Z-shaped sections each integral with the respective frame and each having a pair of said portions.

6. The combination of claim 3, wherein said tumblers further include substantially U-shaped sections each integral with the respective frame and each having a pair of said portions.

7. The combination of claim 3, wherein said portions of said tumblers include wedge-like members tapering in a direction toward the respective frames.

8. In a disc tumbler lock, the combination of a case; a cylinder rotatably mounted in said case and having a key hole; a plurality of disc tumblers disposed transversely of the axis of said cylinder, said cylinder having slots reciprocably receiving said tumblers and each of said tumblers having a passage for the corresponding portion of a key, said tumblers having ribs extending transversely of the axis of said cylinder and said cylinder having surfaces surrounding said slots and conforming to the outlines of the respective tumblers and their ribs; and means for biasing said tumblers transversely of said cylinder to thereby urge said tumblers into said case, said tumblers including enlarged portions extending into said case under the action of said biasing means to prevent rotation of said cylinder in said case in the absence in said key hole of a proper key which maintains said enlarged portions in the interior of said cylinder against the opposition of said biasing means, each of said tumblers including a frame which is provided with the respective passage and each of said frames including a wedge-like section which is urged directly against the key in said hole by said biasing means.

9. The combination of claim 8, wherein each of said wedges tapers in a direction toward the respective passage.

* * * * *